US009500022B1

(12) United States Patent
Shesvill

(10) Patent No.: US 9,500,022 B1
(45) Date of Patent: Nov. 22, 2016

(54) SLIDE SAFE APPARATUS AND METHOD

(71) Applicant: Alexey Shesvill, Lod (IL)

(72) Inventor: Alexey Shesvill, Lod (IL)

( * ) Notice: Subject to any disclaimer, the term of this patent is extended or adjusted under 35 U.S.C. 154(b) by 0 days.

(21) Appl. No.: 14/929,371

(22) Filed: Nov. 1, 2015

(51) Int. Cl.

| | |
|---|---|
| ***E05G 1/026*** | (2006.01) |
| ***E05G 1/04*** | (2006.01) |
| ***E05G 1/10*** | (2006.01) |
| ***E05B 65/00*** | (2006.01) |
| ***E05F 15/643*** | (2015.01) |
| ***E05F 15/635*** | (2015.01) |

(52) U.S. Cl.
CPC ..... *E05G 1/026* (2013.01); *E05B 65/0075* (2013.01); *E05F 15/635* (2015.01); *E05F 15/643* (2015.01); *E05G 1/04* (2013.01); *E05G 1/10* (2013.01)

(58) Field of Classification Search
CPC ..... E05G 1/026; E05G 1/04; E05G 1/10; E05F 15/635; E05F 15/643; E05B 65/0075
USPC ..... 109/58, 59 R, 64
See application file for complete search history.

(56) References Cited

U.S. PATENT DOCUMENTS

| | | | | | |
|---|---|---|---|---|---|
| 2,211,491 | A * | 8/1940 | Brooke | F41A 27/10 | 109/23 |
| 4,887,445 | A * | 12/1989 | Beatty | G07C 9/0069 | 70/214 |
| 5,758,522 | A * | 6/1998 | York | E05B 19/0005 | 109/59 R |
| 7,536,721 | B2 * | 5/2009 | Stevens | G06Q 10/08 | 726/17 |
| 8,065,948 | B1 * | 11/2011 | Baptista | F41A 23/24 | 89/36.14 |

FOREIGN PATENT DOCUMENTS

| | | | | |
|---|---|---|---|---|
| DE | EP 2814008 A1 * | 12/2014 | | A47B 81/00 |
| GB | 2039264 A * | 8/1980 | | E05G 1/10 |
| JP | GB 2360510 A * | 9/2001 | | G07D 11/0009 |

* cited by examiner

*Primary Examiner* — Jerry Redman
(74) *Attorney, Agent, or Firm* — Haim M. Factor

(57) ABSTRACT

A slide safe apparatus having a safe encasement and a sliding, retractable door, the slide safe including: a motor positioned within the safe encasement, the motor mechanically connected to a lead screw having an axial rotational axis and driving a coupling; a linkage positioned within the safe encasement, the linkage having a first end mechanically connected to the coupling and a second end mechanically connected to the retractable door; and a control panel configured to command motor operation and to alternately open and close the retractable door, wherein the lead screw passes through at least part of the linkage.

10 Claims, 6 Drawing Sheets

Detail B

View C - C

View D - D

SLIDE SAFE APPARATUS AND METHOD

FIELD OF THE INVENTION AND BACKGROUND

The present invention relates to secure protection of objects and specifically to a secure slide safe having a protected, retractable door and method thereof.

Safes having various configurations are known in the art for years. Reference is currently made to FIG. 1, which is a frontal view of a prior art safe 5. Prior art safe 5 has a door 7 and hinges 9—both as known in the art. It can be seen in the figure that door 7 typically opens outward and that hinges 9 are externally-mounted to the safe, thereby representing an intrinsic security shortcoming of safe 5. For example, it would be possible to mechanically compromise the hinges of safe 5 to open it. Furthermore, the need for door 7 to open outwards dictates a need for additional space, which may not be appropriate for compact placement of the safe—especially such as in homes and offices, inter alia.

There is therefore a need to have a secure slide safe, having a protected door mechanism, without the need for externally-presented hinges, and a door which does not open outwards, to allow compact placement of the safe.

SUMMARY OF INVENTION

According to the teachings of the present invention there is provided a slide safe apparatus having a safe encasement and a sliding, retractable door, the slide safe including: a motor positioned within the safe encasement, the motor mechanically connected to a lead screw having an axial rotational axis and driving a coupling; a linkage positioned within the safe encasement, the linkage having a first end mechanically connected to the coupling and a second end mechanically connected to the retractable door; and a control panel configured to command motor operation and to alternately open and close the retractable door, wherein the lead screw passes through at least part of the linkage. Preferably, the linkage is maintained in a conduit and the linkage is configured to flex as it translates within the conduit. Most preferably, the linkage includes a plurality of vertical structures connected to one another by connecting links and connecting link pins. Typically, each of the plurality of vertical structures includes a pair of vertical elements connected by a pair of omega connectors and configured to have a circular space formed in each of the plurality of vertical structures. Most typically, the linkage is fabricated from metallic materials, plastic materials, and/or metallic materials and reinforced plastic materials.

According to the teachings of the present invention there is further provided a method of operating a slide safe having a safe encasement and a sliding, retractable door, including the steps of: positioning a motor within the safe encasement, the motor mechanically connected to a lead screw having an axial rotational axis and driving a coupling; configuring a linkage within the safe encasement, the linkage having a first end mechanically connected to the coupling and a second end mechanically connected to the retractable door; and using a control panel to command the motor to alternately open and close the retractable door, whereby the lead screw passes through at least part of the linkage. Preferably, the linkage is maintained in a conduit and the linkage flexes as it translates within the conduit. Most preferably, the linkage includes a plurality of vertical structures connected to one another by connecting links and connecting link pins.

LIST OF FIGURES

The invention is herein described, by way of example only, with reference to the accompanying drawings, wherein.

DETAILED DESCRIPTION

Embodiments of the present invention relate to secure protection of objects and specifically to a secure slide safe having a protected, sliding, retractable door and method thereof.

Figure 1:
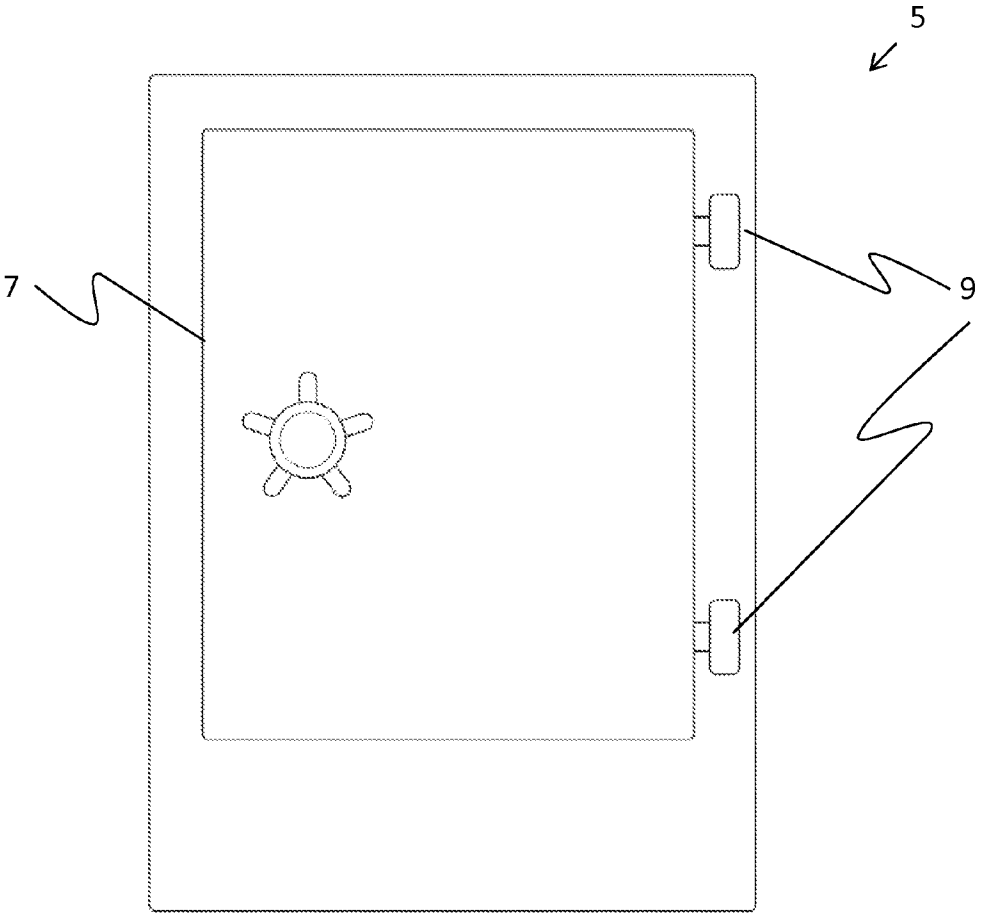
PRIOR ART FIG 1
FIG. 1 is a frontal view of a prior art safe.
Figure 2:
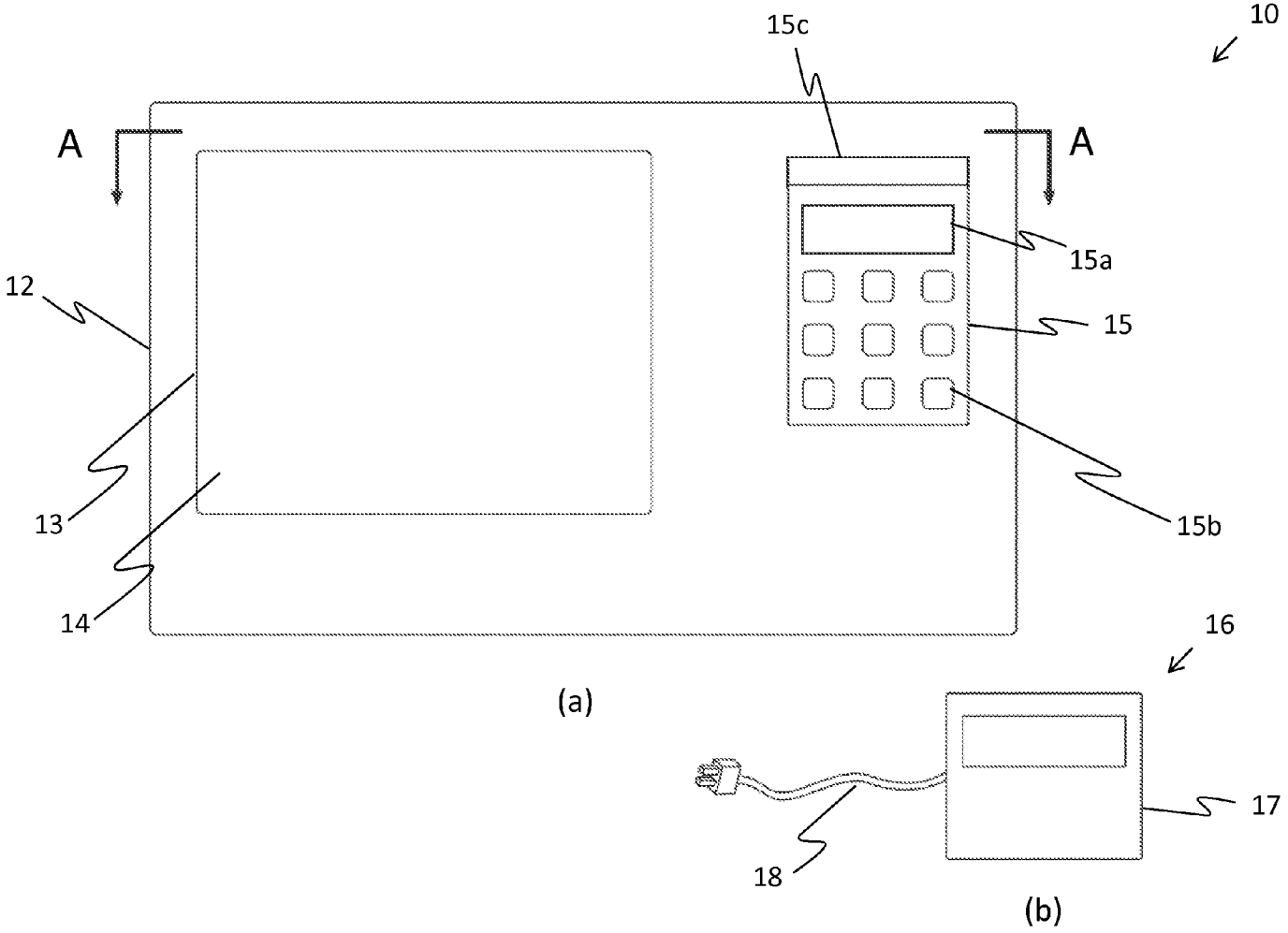
FIG. 2 is a frontal view of a slide safe apparatus 10 in accordance with embodiments of the current invention.

Reference is presently made to FIG. 2, which is a frontal view of a slide safe apparatus 10 (also referred to hereinbelow and in the claims which follow as "slide safe") in accordance with embodiments of the current invention. Slide safe apparatus 10 includes: a safe encasement 12, an opening 13 in the safe encasement; a retractable door 14; a control panel 15 having a display 15*a*; control buttons 15*b*; a recharge port 15*c*; and an external recharge unit 16, having a charger 17, and a mains cord 18. Opening 13 and door 14 define the front direction of safe encasement 12.

The slide safe is operated using control panel 15, through which a security code and/or any other sequence of commands may be entered using control buttons 15*b*. Commands and or other information are displayed on control buttons 15*b*. Commands serve, inter alia, to move retractable door 14 to the right (from a closed position to an open position) or to the left (from an open position to a closed position). The control panel has a rechargeable battery (not seen in the figure) which may be recharged occasionally or in a continuous fashion by inserting charger 17 into recharge port 15*c*. The rechargeable battery provides power for all control panel 15 functionality and to move door 14, as described hereinbelow.

Alternatively or optionally, the rechargeable battery may be removed from behind the control panel for alternate-configuration recharging. Additional description of operational/mechanical features of slide safe 10 follows in subsequent figures, hereinbelow.

Safe encasement 12 has typical exemplary dimensions of 20 inches (width) by 10 inches (height) by 8-12 inches (depth—not shown in the figure). Retractable door 14 has exemplary dimensions of 9 inches (width) by 8 inches (height) by 1 inch (thickness) and is larger in width and height than opening 13. Both the safe encasement and the door are made of typical safe materials as known in the art, namely thick steel and/or other hard/strong metallic materials. The exemplary dimensions of safe encasement 12 and of retractable door 14 noted hereinabove may vary, mutatis mutandis, in accordance with specific safe scale/size and placement requirements.

Figure 3:
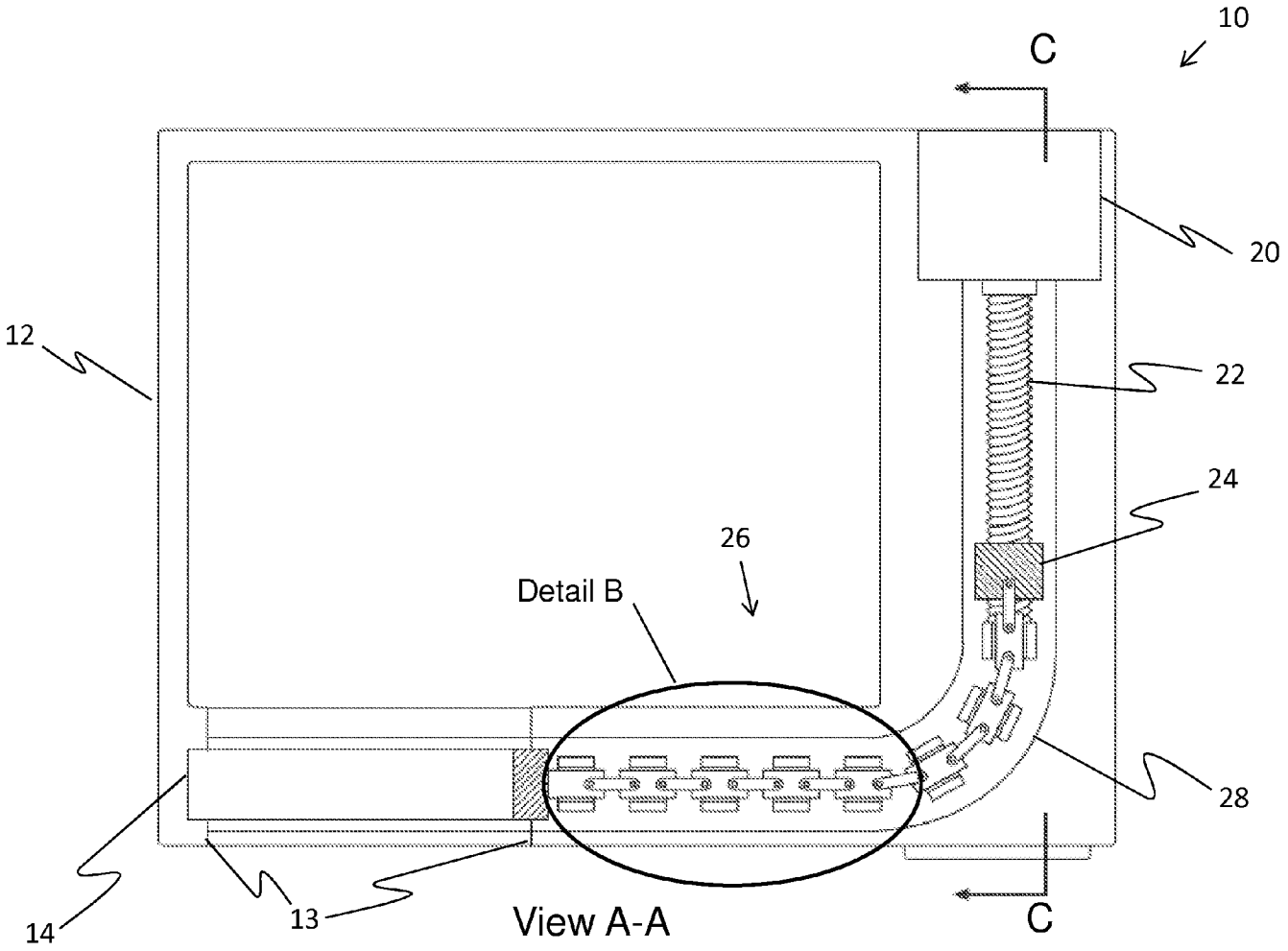
FIG. 3 is a top sectional view A-A of the slide safe apparatus shown in FIG. 2, in accordance with embodiments of the current invention.

Reference is currently made to FIG. 3, which is a top sectional view A-A of slide safe apparatus 10 shown in FIG. 2, in accordance with embodiments of the current invention. Apart from differences described hereinbelow slide safe apparatus 10 is identical in notation, configuration, and functionality to that shown in FIG. 2, and elements indicated by the same reference numerals and/or letters are generally identical in configuration, operation, and functionality as described hereinabove. The slide safe includes: a motor 20; a lead screw 22; a coupling 24; a linkage 26; and a conduit 28. Motor 20 is positioned within the safe encasement, opposite the front of the safe and is powered by the rechargeable battery, as noted hereinabove. The motor is mechanically connected to lead screw 22 (the lead screw defining an axial rotational axis) with the motor controllably rotating the lead screw. Coupling 24 rides on lead screw 24, and is configured, as known in the art, so that rotation of lead screw 24 in a first direction drives coupling 24 towards the motor; and rotation of lead screw in a second direction (opposite to the first direction) drives coupling 24 away from the motor. Linkage 26 has two ends and is mechanically connected to coupling 24 at a first end and is mechanically connected to retractable door 14 at a second end of the linkage. The mechanical connection of the coupling and the first end of the linkage is described further hereinbelow. The linkage is maintained and translates within conduit 28. Linkage 26 has a configuration allowing the lead screw to pass through at least part of the linkage, as described hereinbelow in subsequent figures.

Retractable door 14 is shown in the current figure in a closed configuration, behind opening 13. The retractable door may be translated to an open configuration (not shown in the current figure) by appropriately operating motor 20 to rotate lead screw 24, thereby driving coupling 24 and attached linkage 26 towards the motor, as noted hereinabove.

Figure 4:
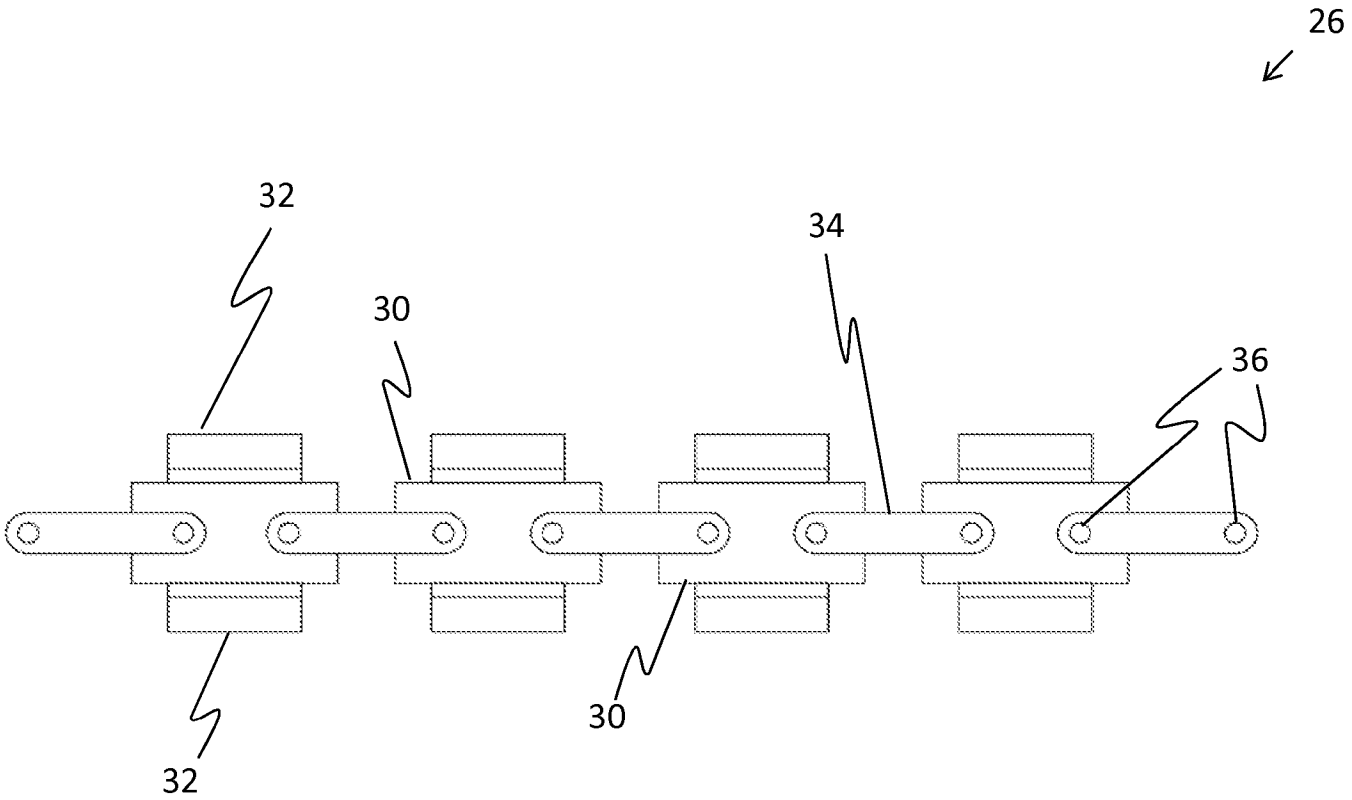
FIG. 4 is a detail view B of the linkage shown in FIG. 3, in accordance with embodiments of the current invention.
Figure 5:
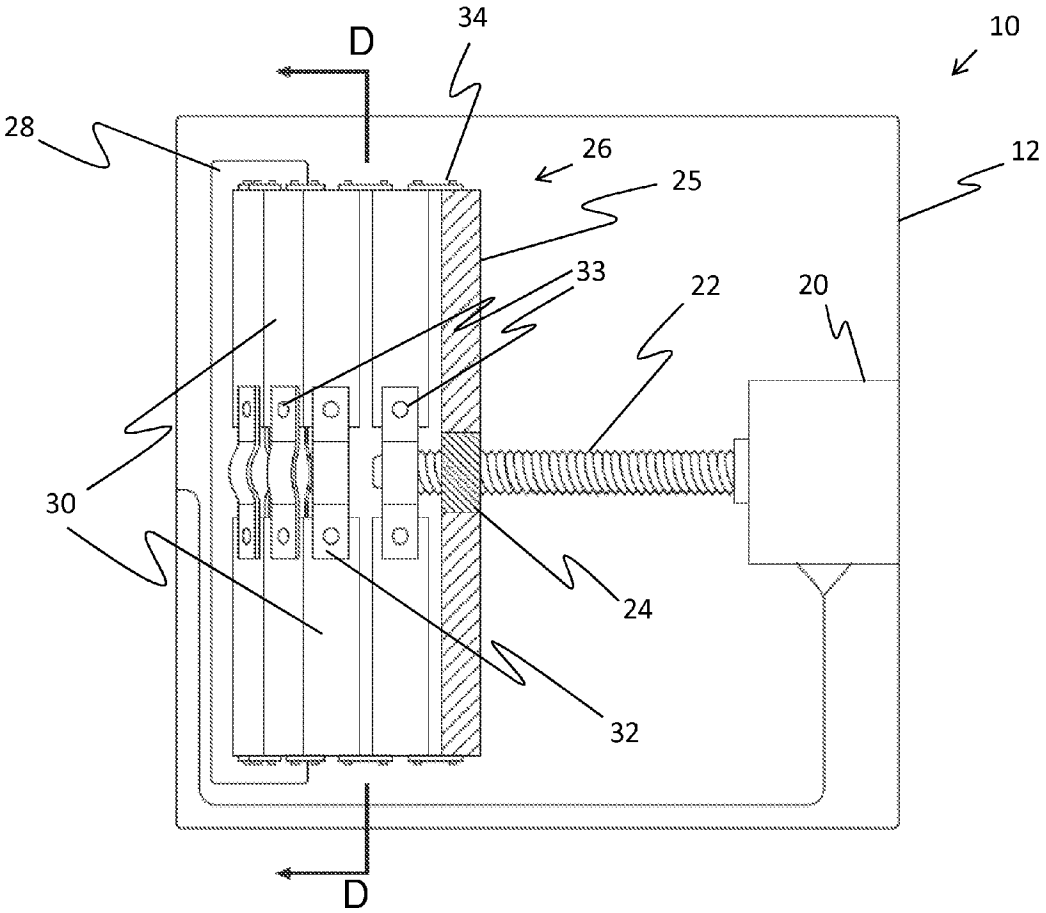
FIG. 5 is an elevation sectional view C-C of the slide safe apparatus shown in FIG. 3, in accordance with embodiments of the current invention.
Figure 6:
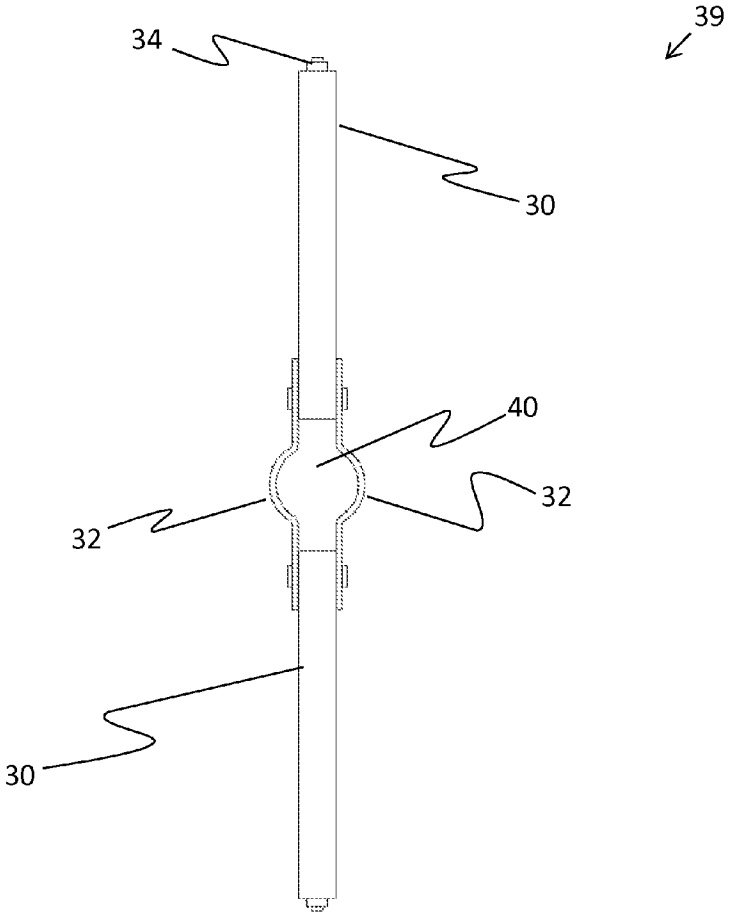
FIG. 6 is an elevation sectional view DD of part of the linkage shown in FIGS. 5 and 4, in accordance with embodiments of the current invention

Reference is currently made to FIGS. 4 to 6, which are: a detail view B of linkage 26 shown in FIG. 3 and a side; an elevation sectional view C-C of slide safe apparatus 10 shown in FIG. 3; and an elevation sectional view D-D of linkage 26 shown in FIG. 5; respectively, in accordance with embodiments of the current invention. Apart from differences described hereinbelow linkage 26 and slide safe apparatus 10 are identical in notation, configuration, and functionality to that shown in FIG. 3, and elements indicated by the same reference numerals and/or letters are generally identical in configuration, operation, and functionality as described hereinabove.

Linkage 26 includes: a first end vertical element 25, vertical elements 30; omega connectors 32; omega connecting pins 33; connecting links 34; and connecting link pins 36. As is seen in the three referenced figures, linkage 26 is constructed from a plurality of pairs of elongated vertical elements 30, each pair being rigidly, mechanically attached to one another by two omega connectors 32 and with omega connecting pins 33 so that the pairs of vertical elements with the omega connectors form a rigid vertical structure 39. The vertical elements define a vertical axis.

A circular space 40 is formed within the vertical structure to allow lead screw 22 to pass there through, as described hereinbelow. The vertical structures are subsequently connected to one another by connecting links 34, using connecting link pins 36, to form linkage 26. Vertical structures in linkage 26 are mechanically fixed along the lead screw axis, but vertical structures may partially rotate about their respective vertical axis—allowing linkage 26 to flex as it translates along conduit 28, which has a curved 90-degree turn configuration, as shown in the figure.

Optionally or alternatively, additional pairs of connecting links 34, with their connecting link pins 36 may be used to further secure adjoining rigid structures 39 at the interior ends of pairs of vertical elements (i.e. in proximity to circular space 40)—not shown in the figures.

In one embodiment of the current invention, first end vertical element 25 is a rigid vertical element within which coupling 24 is formed or bonded, or alternatively a rigid element is tapped (threading is made therein) so that the rigid element, ie first end vertical element 25 itself, serves the function of coupling 24.

Linkage 26 and elements that form it are made typically from metallic materials and/or reinforced plastic materials as known in the art, affording mechanical strength and good wearability.

It will be appreciated that the above descriptions are intended only to serve as examples, and that many other embodiments are possible within the scope of the present invention as defined in the appended claims.

The invention claimed is:

1. A slide safe apparatus having a safe encasement and a sliding, retractable door, the slide safe including:

a motor positioned within the safe encasement, the motor mechanically connected to a lead screw having an axial rotational axis and driving a coupling;

a linkage positioned within the safe encasement, the linkage having a first end mechanically connected to the coupling and a second end mechanically connected to the retractable door; and a control panel configured to command motor operation and to alternately open and close the retractable door, wherein the lead screw passes through at least part of the linkage.

2. The apparatus of claim 1, wherein the linkage is maintained in a conduit and the linkage is configured to flex as it translates within the conduit.

3. The apparatus of claim 2, wherein the linkage includes a plurality of vertical structures connected to one another by connecting links and connecting link pins.

4. The apparatus of claim 3, wherein each of the plurality of vertical structures includes a pair of vertical elements connected by a pair of omega connectors and configured to have a circular space formed in each of the plurality of vertical structures.

5. The apparatus of claim 1, wherein the linkage is fabricated from metallic materials.

6. The apparatus of claim 1, wherein the linkage is fabricated from reinforced plastic materials.

7. The apparatus of claim 1, wherein the linkage is fabricated from metallic materials and reinforced plastic materials.

8. A method of operating a slide safe having a safe encasement and a sliding, retractable door, including the steps of:

positioning a motor within the safe encasement, the motor mechanically connected to a lead screw having an axial rotational axis and driving a coupling;

configuring a linkage within the safe encasement, the linkage having a first end mechanically connected to the coupling and a second end mechanically connected to the retractable door; and using a control panel to command the motor to alternately open and close the retractable door, whereby the lead screw passes through at least part of the linkage.

9. The method of claim 8, whereby the linkage is maintained in a conduit and the linkage flexes as it translates within the conduit.

10. The method of claim 9, whereby the linkage includes a plurality of vertical structures connected to one another by connecting links and connecting link pins.

* * * * *